United States Patent [19]

LaGrone et al.

[11] 4,240,520

[45] Dec. 23, 1980

[54] HI RISE ESCAPE TUNNELS AND SLIDE

[76] Inventors: Janet L. LaGrone; George Spector, both of 3615 Woolworth Building, 233 Broadway, New York, N.Y. 10007

[21] Appl. No.: 7,652

[22] Filed: Jan. 29, 1979

[51] Int. Cl.[3] ..... A62B 1/20

[52] U.S. Cl. ..... 182/48; 182/47; 193/25 R

[58] Field of Search ..... 182/48, 49, 46, 47; 193/25 R

[56] References Cited

U.S. PATENT DOCUMENTS

| | | | |
|---|---|---|---|
| 192,500 | 6/1877 | Goble | 182/48 |
| 386,253 | 7/1888 | Marcus et al. | 182/48 |
| 672,623 | 3/1901 | Jennings | 182/48 |
| 935,447 | 9/1909 | Woods | 182/48 |
| 1,309,950 | 7/1919 | Lazuka | 182/48 |
| 3,819,011 | 6/1974 | Kinase et al. | 182/48 |
| 4,099,596 | 7/1978 | Tracy | 182/48 |

FOREIGN PATENT DOCUMENTS

| | | | |
|---|---|---|---|
| 9947 | of 1908 | United Kingdom | 182/48 |

*Primary Examiner*—Reinaldo P. Machado

[57] ABSTRACT

A fire escaping tunnel for use on high use buildings, including an extendable accordian pleated tubing made of nylon or canvas fabric padded on its inner side, a ring at its upper end attachable to an escape opening of a building, a lower end of the tubing having a soft landing pad, and an exit doorway so a person sliding or lowered down the tunnel can step out upon a ground or street level.

3 Claims, 4 Drawing Figures

HI RISE ESCAPE TUNNELS AND SLIDE

This invention relates generally to fire escapes for tall buildings such as high risers.

It is well known that a conventional fire escape comprised of a steel framework of landings and ladders is sometimes not suitable for use by persons trying to get out of a burning building because the person on the fire escape is not protected from flames coming from a side window of the building. Thus leaving a building can be blocked if a lower portion of a fire escape is engulfed in flames. This situation is objectionable and is threrefore in want of an improvement.

Therefore, it is a principal object of the present invention to provide a new type of fire escape for taller buildings such as high risers, and which comprises a tunnel closed around all its sides so that flames alongside cannot reach persons escaping down inside the tunnel.

Another object is to provide a high rise escape tunnel which is accordian pleated so that when not in use, it can be stored collapsed in a small out-of-the-way space, but which when needed can then be readily extended down to a ground from an upper floor of a tall building so persons can travel down inside of it.

Still another object is to provide a high rise escape tunnel which in one design allows persons to slide down inside it, another design allows lowering a person on a chair therewithin, and still another design includes a spiralled chute so that even children can safely slide down alone without fear of height.

Still another object is to provide a high rise tunnel escape which would be ideal for use by school buildings, hospitals, tall apartment houses, office buidings and the like.

Figures 1, 2, 3, 4, 5:
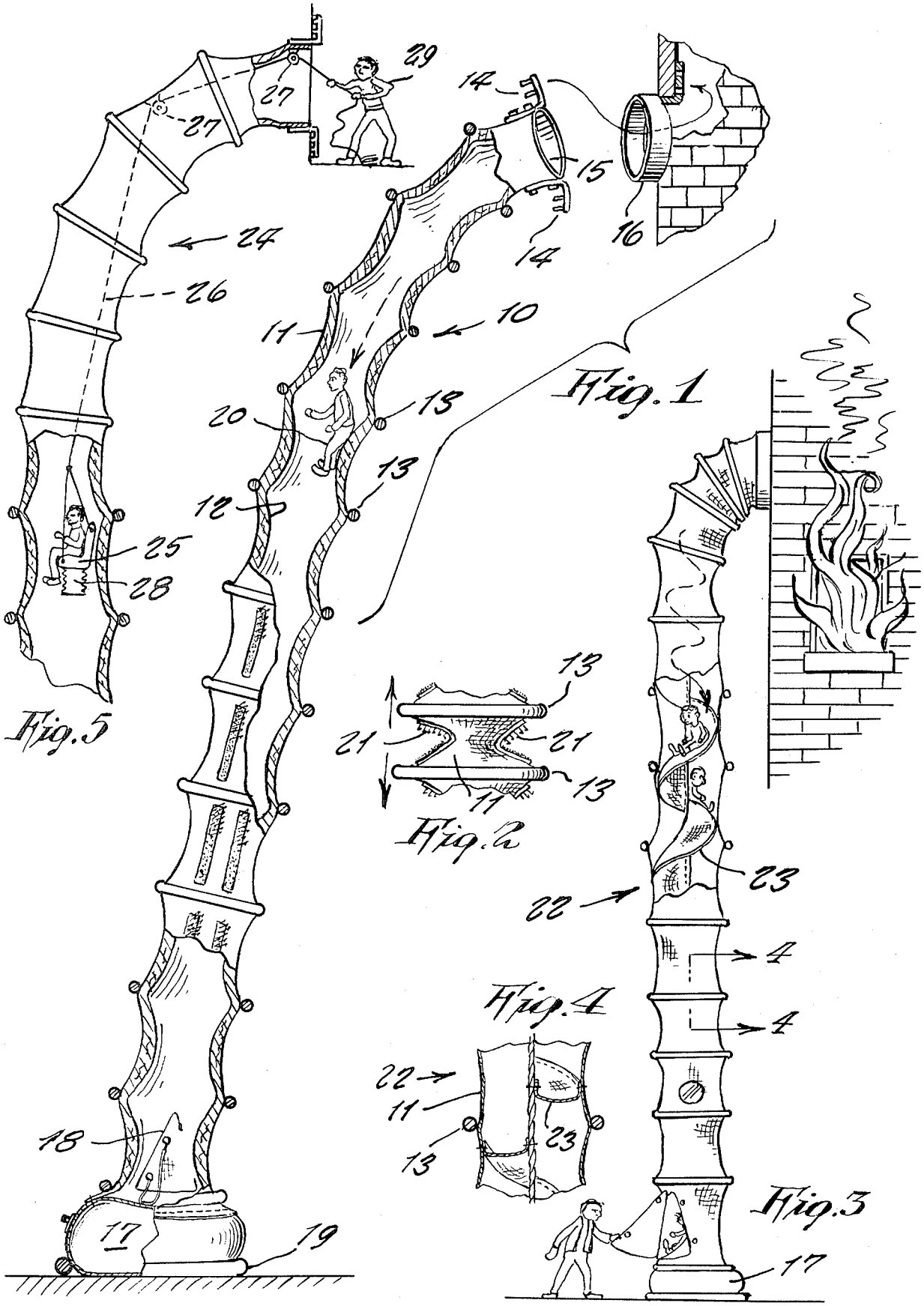
FIG. 1 is a side view of the invention partly in cross section and shown including a tension device that unsnaps the door open when a person depresses the bottom cushion, on arrival at the bottom.
FIG. 2 is s small detail showing how the Velcro components serve to detatch so to lower the chute gently.
FIG. 3 is a view similar to FIG. 1, and showing a modified construction in which a spiral shaped slide is made of canvas inside the chute so that persons can slide safely down instead rapidly falling down, so that it will not be as fearful for children to go down alone, and which also allows the chute thus to hang vertically instead trying to keep it inclined at angle for sliding straight.
FIG. 4 is a cross section on line 4—4 of FIG. 3.

Referring now to the drawing in greater detail, and more particularly to FIGS. 1 and 2 thereof at this time, the reference numeral 10 represents a high rise escape tunnel according to the present invention wherein there is a long tubing 11 made of fireproofed canvas or nylon fabric and having foam material padding 12 on its inner side. Circular, plastic rings 13 are secured around its outer side at spaced intervals.

A plurality of hooks 14 at the upper entry 15 of the tubing, allows connection to a steel ring 16 installed in a wall or window of a building. A lower end of the tubing has a pad 17 that is either air-inflated or else is made of foam material so to allow a soft landing for persons dropping thereupon. A doorway 18 of fabric, at the lower end is held closed by snap fasteners so to be easily kicked open from inside by an escaping person. A heavy metal ring 19 at a lower edge of pad 17 rests on a ground.

When not used, the escape tunnel is stored in an accordian collapsed position on an upper floor of a building. In case of a fire, it is simply pushed out over a side of the building so to extend down to a ground. A person 20 then simply slides down safely inside.

As shown in FIG. 2, Velcro strips 21 aid to hold the tunnel in a contracted condition, when in a stored position.

Alternately, a ladder may be placed inside the tunnel so to allow a person to climb down.

In another design of tunnel 22 shown in FIGS. 3 and 4, a spiral slide 23 inside the tunnel is made of canvas, is more ideal for children as it would be less frightening to enter than a vertical opening. This would be particularly good for school buildings so children will use it without accompanyment by an adult. Windows can be included to let light in.

In FIG. 5, still another design of tunnel 24 includes a seat 25 padded with foam rubber, and is lowered on a rope 26 fitted around pulleys 27. An accordian pleated cushion 28 under the seat serves as a shock absorber upon impact at a bottom of the tunnel. A last person 29 leaving a building can lower himself on the seat while handling the rope at a same time.

What is claimed:

1. A high rise escape tunnel, comprising in combination, a collapsible tubing of fireproof fabric, a padding on its inner side a plurality of spaced apart metal rings mainted around an outer side of said tubing, an entry opening at an upper end of said tubing, an exit doorway near a lower end, a soft pad at said lower end for resting on a ground, said pad encompassed by a weighted ring for contacting the ground, means for connecting said entry opening to a building exit whereby said tunnel assumes curved shape having increasing inclination towards the ground, said rings having equal diameter whereby said tubing fabric sags inwardly between the rings to provide a smooth undulating curvate sliding surface in further combination with means mounted on the tubing for contracting the tubing longitudinally for storage purposes.

2. A tunnel as in claim 1 in further combination with a flexible spiral slide mounted in said tubing having half a diameter width including a rope ladder provided along the tubing.

3. A tunnel as in claim 1 in combination with chair sling supported by means mounted in the tunnel and the first said means for lowering the chair sling.

* * * * *